US005836385A

United States Patent [19]

Koopmans

[11] Patent Number: 5,836,385

[45] Date of Patent: Nov. 17, 1998

[54] APPARATUS FOR DEPLOYING WIRELINE

[76] Inventor: Sietse Jelle Koopmans, Hoogeind 29A, 2321, Meer, Belgium

[21] Appl. No.: 860,501

[22] PCT Filed: Dec. 29, 1995

[86] PCT No.: PCT/GB95/03050

§ 371 Date: Jun. 27, 1997

§ 102(e) Date: Jun. 27, 1997

[87] PCT Pub. No.: WO96/21081

PCT Pub. Date: Jul. 11, 1996

[30] Foreign Application Priority Data

Dec. 29, 1994 [GB] United Kingdom ..... 9426323

[51] Int. Cl.[6] ..... E21B 19/08

[52] U.S. Cl. ..... 166/77.1; 166/385

[58] Field of Search ..... 166/77.1, 77.2, 166/85.5, 385, 384, 379

[56] References Cited

U.S. PATENT DOCUMENTS

| | | | |
|---|---|---|---|
| 3,381,940 | 5/1968 | Walstrom | 254/173 |
| 4,050,858 | 9/1977 | Ewbank et al. | 417/234 |
| 4,265,304 | 5/1981 | Baugh | 166/77.2 |
| 4,416,329 | 11/1983 | Tanner et al. | 166/68 |
| 4,585,061 | 4/1986 | Lyons, Jr. et al. | 166/77.3 |
| 4,684,306 | 8/1987 | Brewer et al. | 414/22.68 |
| 4,756,366 | 7/1988 | Maroney et al. | 166/250 |
| 5,040,926 | 8/1991 | Andreasson | 405/232 |
| 5,211,203 | 5/1993 | Vollweiler et al. | 137/355.17 |
| 5,348,096 | 9/1994 | Williams | 166/384 |
| 5,411,085 | 5/1995 | Moore et al. | 166/242 |
| 5,454,419 | 10/1995 | Vloedman | 166/77.2 |

FOREIGN PATENT DOCUMENTS 326493 9/1977 European Pat. Off. .

OTHER PUBLICATIONS

Blount et al, "Coiled tubing operations and services", Wordl Oil., May 1992.

*Primary Examiner*—Hoang C. Dang

*Attorney, Agent, or Firm*—Gifford, Krass, Groh, Sprinkle, Patmore, Anderson & Citkowski,P.C.

[57] ABSTRACT

The invention relates to apparatus 10 for use in deploying slickline, wireline and the like. The apparatus 10 is truck mounted and comprises a slickline unit 12 mounted via a swivel on a truck bed 14, and a support arm 16 pivotally mounted on the unit. The arm 16 may be lifted from a horizontal transport position (FIG. 1) to a raised position (FIG. 2) by hydraulic rams, and is telescopic and may be extended to almost three times its retracted, transport length. In its extended configuration the arm 16 may support a pressure lubricator 18 and top and bottom pulleys 20, 22 from a support cable 17 which extends along the arm from a pulley 19 mounted on the lower end of the arm.

9 Claims, 2 Drawing Sheets

17
18
20
22
14
16
19
12
36
10
34

16
12
3
14
36
34

APPARATUS FOR DEPLOYING WIRELINE

FIELD OF THE INVENTION

The present invention relates to apparatus for use in deploying slickline, wireline and the like. The invention has particular application for use in relation to well bores typically, but not uniquely, provided in connection with the oil and gas exploration and extraction industries.

BACKGROUND OF THE INVENTION

At present, at a well bore site where wireline, slickline or the like is to be utilised, it is necessary to provide slickline apparatus, such as described in EP-A-0 448 842, including a winch drum on which the slickline is stored, a measuring head, drum motors and brakes, and a control station for the operator. Such apparatus is currently available in an easily transportable form, as described in the abovementioned patent application where the apparatus comprises two parts, a drive unit and a winching unit, both of which may be transported on a truck bed. The units are adapted to be moved on site using forklifts, or a wheel-mounted frame which may be lifted by crane. Additionally, it is necessary to provide a crane or mast to support the pressure lubricator and the pulleys over which the slickline passes before entering the pressure lubricator and the well bore. This requires provision of a second vehicle to transport the crane or mast to the site. Further, once on site, the winch apparatus, in particular the winch drum, must be accurately aligned with the pulleys, to ensure reliable deployment and take in of line.

It is among the objects of the present invention to obviate or mitigate these difficulties.

SUMMARY OF THE INVENTION

According to the present invention there is provided apparatus for use in deploying slickline, wireline and the like comprising: a portable bed for supporting a mounting table; winch apparatus including a winch drum for carrying a coil of line; and an arm moveable from a transport position to a raised position for mounting a pressure lubricator and associated pulleys, the winch drum and the arm being aligned and mounted on the mounting table.

In use, the present invention obviates the need for a separate winch apparatus and mast or crane. Further, as the winch drum and arm are mounted on a common mounting table the drum and arm are pre-aligned, providing a significant saving in set-up time. The common mounting also reduces the area occupied on a site by slickline or wireline apparatus, and also provides for greater flexibility in locating the apparatus on-site.

Preferably, the bed is in the form of a trailer, truck bed or detachable transport bed, such that the apparatus may be easily transported between sites. In conventional systems, multiple vehicles may be necessary to transport the mast or crane and the winch apparatus. Preferably also, the truck also carries a container unit suitable for storing all of the other apparatus necessary for carrying out slickline or wireline operations.

Preferably also, the arm is telescopic and is moveable between a retracted transport configuration and an extended support configuration.

Preferably also, the mounting table is movably mounted on the bed, most preferably being rotatable about a vertical axis. Conveniently, the mounting table is mounted on a swivel.

Preferably also, the winch apparatus is contained within a winch unit also housing winch controls, an operator station, a winch motor and winch brake. Most preferably, a measuring head is provided with the winch unit.

BRIEF DESCRIPTION OF THE DRAWINGS

This and other aspects of the invention will now be described, by way of example, with reference to the accompanying drawings, in which.

DETAILED DESCRIPTION OF DRAWINGS

Figures 1, 2:
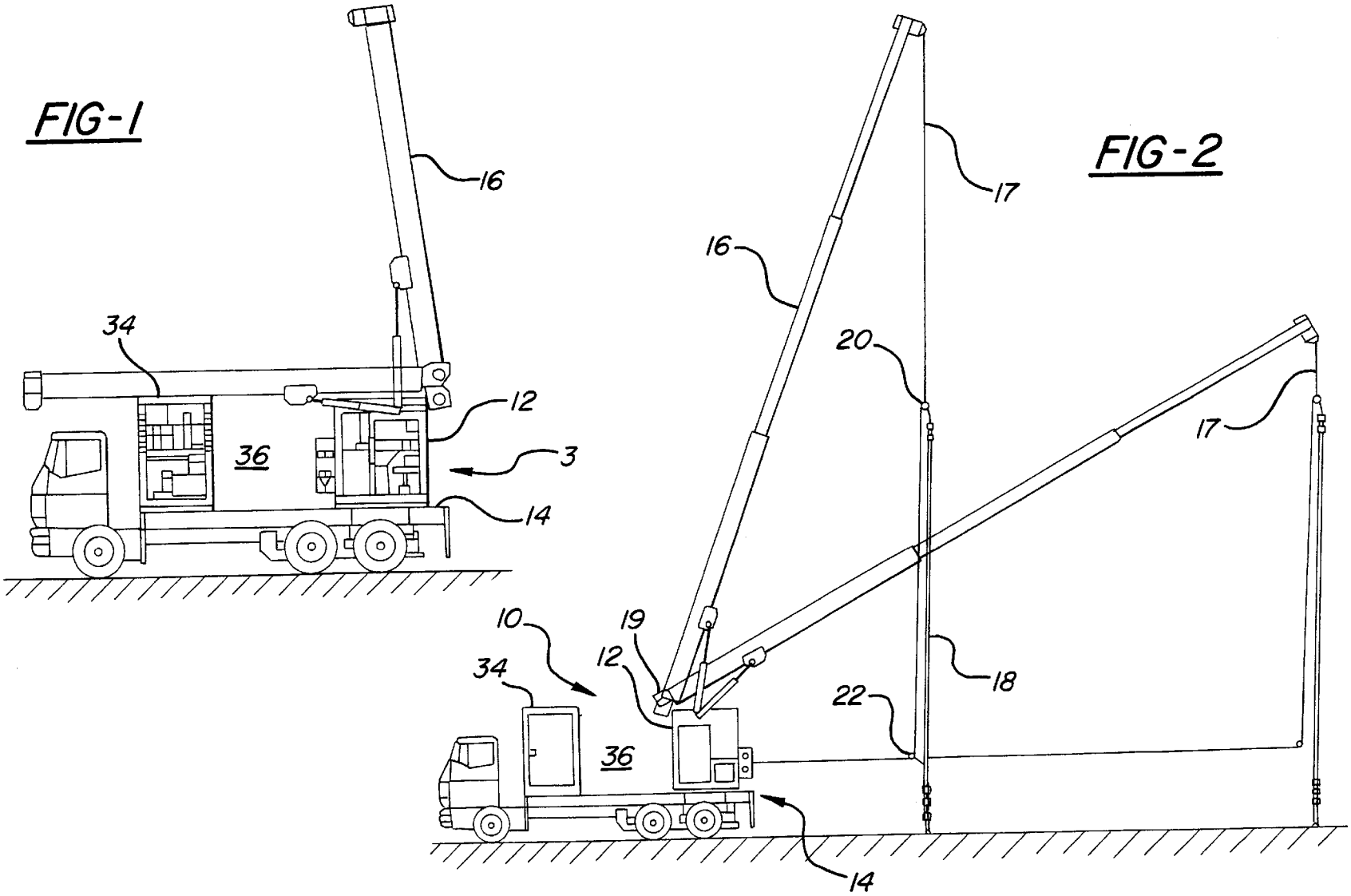
FIG. 1 is a side view of slickline deploying apparatus in accordance with a preferred embodiment of the present invention, shown in the transport configuration.
FIG. 2 is a side view of the apparatus of FIG. 1, shown in the deployed position.

Reference is first made to FIGS. 1 and 2 of the drawings, which illustrate slickline apparatus in accordance with a preferred embodiment of the present invention. The apparatus 10 is truck mounted and comprises a slickline unit 12 mounted via a swivel on a truck bed 14, and a support arm 16 pivotally mounted on the unit. The arm 16 may be lifted from a horizontal transport position (FIG. 1) to raised positions (FIG. 2) by hydraulic rams, and is telescopic and may be extended to almost three times its retracted, transport length. In its extended configuration the arm 16 may support a pressure lubricator 18 and top and bottom pulleys 20, 22 from a support cable 17 which extends along the arm from a pulley 19 mounted on the lower end of the arm.

Figure 3:
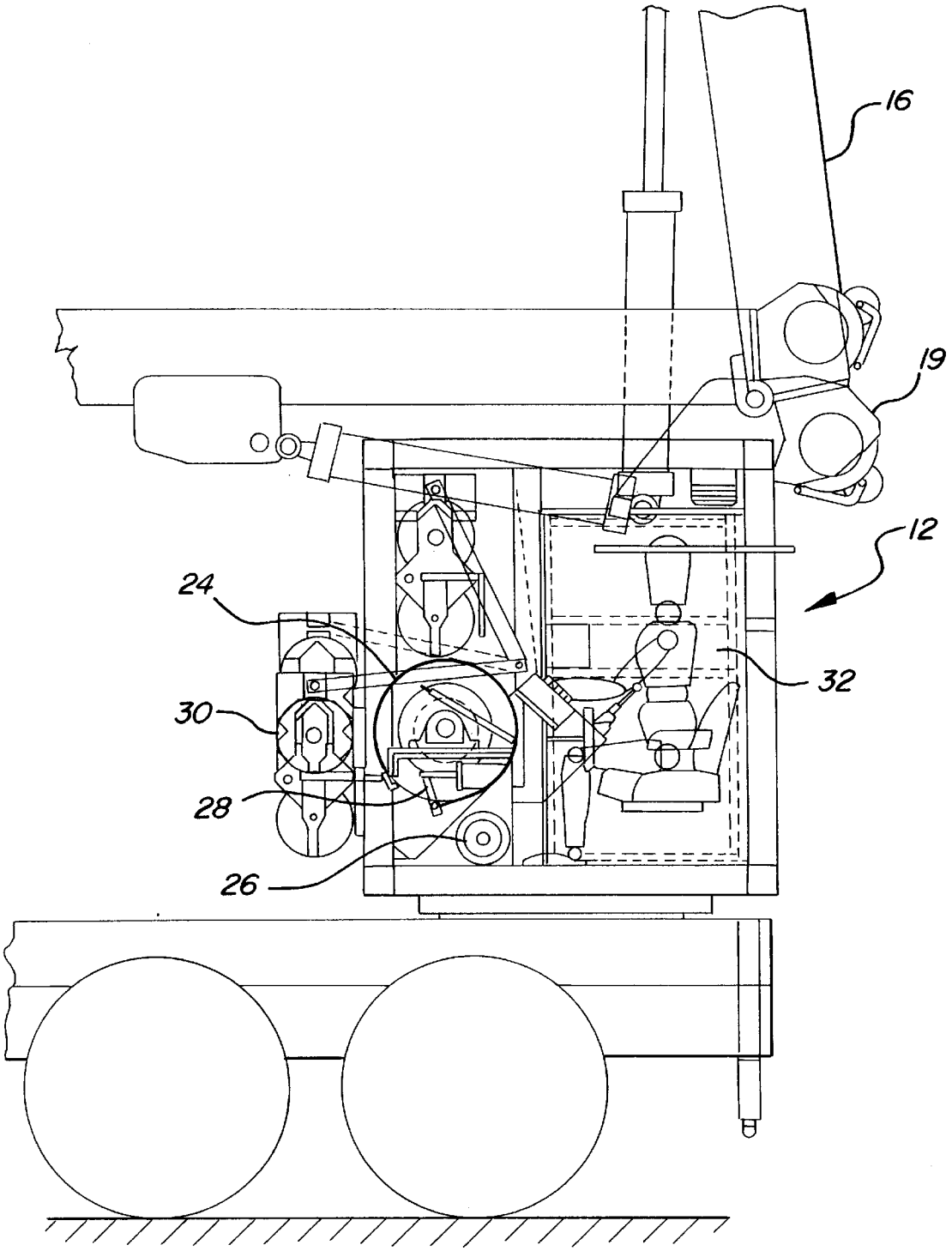
FIG. 3 is an enlarged view of area 3 of FIG. 1.

Reference is now also made to FIG. 3 of the drawings, which shows the slickline unit 12 in greater detail. The unit is substantially self-contained and accommodates a winch drum 24, hydraulic winch motor 26, winch brake 28, measuring head 30, and operator station 32. The measuring head is mounted on swing arms and is movable from a transport position within the unit 12 to an operating position in front of the winch drum 24.

The truck bed 14 also provides mounting for a storage unit 34, for tools and the like. The space 36 on the bed between the slickline unit 12 and the storage unit 34 is left clear to accommodate the segments of the disassembled pressure lubricator 18 or segments of assembled lubricator.

To operate the apparatus, the truck is driven to the site and located at a suitable distance from the bore. The truck stabilisers 38 are then extended and the slickline unit 12 rotated to an appropriate position. The pressure lubricator sections are then lifted from the bed 14 and assembled, before being attached to the end of the support cable 17. The measuring head may then be moved to the operating position and the operator station prepared. Slickline may then be taken from the winch drum and passed through the measuring head, around the pulleys and through the pressure lubricator. The free end of the arm is then extended to suspend the pressure lubricator. The swivel, hydraulic rams, and support cable may then be adjusted to position the pressure lubricator directly over the well bore. The operator then takes up position in the operator station 32 and deploys the slickline.

This operation is relatively straightforward and may be accomplished in a much shorter time than is possible with conventional top side slickline or wireline arrangements, such as that described in EP-A-0 448 842, in which the separate drive unit and winch unit must be unloaded from the truck which brought them to the site, coupled together and then aligned with a slickline operations support mast which will have been transported separately and set up over the bore. As the winch drum and the arm of the present invention are commonly mounted on the swivel, there is no requirement to align the drum with the bottom pulley, and the common mounting also reduces the ground area that is required to accommodate the apparatus, which is particularly useful in difficult terrain sites where ground may have to cleared and levelled to accommodate the apparatus.

It will be clear to those of skill in the art that the above described apparatus is merely exemplary of the present invention and that various modifications and improvements may be made thereto without departing from the scope of the present invention. In particular, the above embodiment relates to slickline deployment apparatus, but the invention may equally be used in conjunction with wireline or other forms of line or cable.

I claim:

1. Apparatus for use in deploying slickline, wireline and the like comprising: a portable bed; a mounting table rotatable on the bed about a vertical axis; winch apparatus including a winch drum for carrying a coil of line; and an arm movable from a transport position to a raised position for supporting a pressure lubricator and associated pulleys, the winch drum and the arm being aligned and mounted on the table.

2. The apparatus of claim 1, wherein the bed is in the form of a truck bed, such that the apparatus may be easily transported between sites.

3. The apparatus of claim 2, wherein the bed also carries a container unit and provides a storage area for other apparatus necessary for carrying out slickline or wireline operations.

4. The apparatus of claim 1, wherein the arm is telescopic and is movable between a retracted transport configuration and an extended support configuration.

5. The apparatus of claim 1, wherein the mounting table is mounted on a swivel.

6. The apparatus of claim 1, wherein the winch apparatus is contained within a winch unit which also contains winch controls, an operator station, a winch motor and winch brake.

7. The apparatus of claim 6, wherein a measuring head is provided within the winch unit and is movable from a transport position within the unit to a working position outside the unit.

8. Apparatus for use in deploying slickline, wireline and the like comprising:

a portable bed supporting a mounting table, the mounting table being movably mounted on the bed;

a winch unit containing a winch drum for carrying a coil of line, winch controls, an operator station, a winch motor and a winch brake; and an arm movable from a transport position to a raised position for supporting a pressure lubricator and associated pulleys, the winch unit and the arm being mounted on the table with the winch drum and arm in alignment.

9. Deployment apparatus for deploying slickline, wireline and the like, the apparatus comprising: a portable bed, a mounting table mounted on the bed via a swivel; winch apparatus including a winch drum carrying a coil of line; a pressure lubricator and associated pulleys; and an arm movable from a transport position to a raised position for supporting the pressure lubricator and pulleys, the winch drum and the arm being aligned and mounted on the table.

* * * * *